US008220445B2

(12) United States Patent
Bednar et al.

(10) Patent No.: US 8,220,445 B2
(45) **Date of Patent: *Jul. 17, 2012**

(54) CROSSBOW GRIP GUARD

(75) Inventors: Richard L. Bednar, Munroe Falls, OH (US); Michael J. Shaffer, Mogadore, OH (US)

(73) Assignee: Hunter's Maunfacturing Company, Inc., Suffield, OH (US)

( * ) Notice: Subject to any disclaimer, the term of this patent is extended or adjusted under 35 U.S.C. 154(b) by 119 days.

This patent is subject to a terminal disclaimer.

(21) Appl. No.: 12/684,301

(22) Filed: Jan. 8, 2010

(65) Prior Publication Data

US 2010/0154768 A1 Jun. 24, 2010

Related U.S. Application Data

(63) Continuation-in-part of application No. 12/571,595, filed on Oct. 1, 2009, which is a continuation of application No. 11/489,773, filed on Jul. 20, 2006, now Pat. No. 7,661,418.

(60) Provisional application No. 60/700,876, filed on Jul. 20, 2005.

(51) Int. Cl.
*F41B 5/12* (2006.01)

(52) U.S. Cl. ..... 124/25

(58) Field of Classification Search ..... 124/25, 124/86, 88

See application file for complete search history.

(56) References Cited

U.S. PATENT DOCUMENTS

| | | | | |
|---|---|---|---|---|
| 859,932 | A | 7/1907 | Edwards | |
| 1,037,486 | A | 9/1912 | Johnson | |
| 2,312,150 | A | 2/1943 | Conner | |
| 2,674,822 | A | 4/1954 | Studler | |
| 2,965,994 | A | 12/1960 | Sullivan | |
| 2,981,154 | A | 4/1961 | Sweeney | |
| 3,090,150 | A | 5/1963 | Stoner | |
| 3,224,427 | A * | 12/1965 | Ronan | 124/25 |
| 3,242,917 | A | 3/1966 | Benedict | |
| 3,641,691 | A | 2/1972 | Ellis et al. | |
| 4,258,689 | A | 3/1981 | Barnett | |
| 4,536,982 | A | 8/1985 | Bredbury et al. | |
| 4,663,875 | A | 5/1987 | Tatro | |
| 4,733,489 | A | 3/1988 | Kurak | |
| D300,161 | S | 3/1989 | Baldus et al. | |
| 5,010,676 | A | 4/1991 | Kennedy | |
| 5,103,714 | A | 4/1992 | LaFrance | |
| 5,198,600 | A | 3/1993 | E'Nama | |
| 5,343,650 | A | 9/1994 | Swan | |

(Continued)

OTHER PUBLICATIONS

Horton One Shot, One Choice, Catalog Number Twelve, circa 1998, pp. 1-3.

*Primary Examiner* — John Ricci

(74) *Attorney, Agent, or Firm* — Brouse McDowell; Stephen J. Presutti

(57) ABSTRACT

A crossbow grip guard for preventing the fingers of an associated user from extending above a top portion of a stock of an associated crossbow. The crossbow grip guard may be adapted to be retro-fitted to an existing crossbow and may comprise a main body and an outwardly extending member that extends away from an exterior surface of the main body to create an obstacle or barrier positioned along a length of the main body and is designed to prevent the fingers of the associated user from extending above the top portion of the stock when firing the crossbow.

18 Claims, 16 Drawing Sheets

U.S. PATENT DOCUMENTS 5,590,484 A 1/1997 Mooney et al.
5,630,405 A 5/1997 Nizov
5,678,528 A * 10/1997 Hadley ..... 124/25
5,826,363 A 10/1998 Olson
5,930,935 A 8/1999 Griffin
6,134,823 A 10/2000 Griffin
6,293,040 B1 9/2001 Luth
6,381,895 B1 5/2002 Keeney et al.
6,449,893 B2 9/2002 Spinner
6,609,321 B2 8/2003 Faifer
D486,547 S 2/2004 Faifer
6,705,304 B1 3/2004 Pauluhn
6,836,990 B2 1/2005 Shiloni
6,868,845 B1 3/2005 Moore
7,661,418 B2 * 2/2010 Bednar et al. ..... 124/25

* cited by examiner

CROSSBOW GRIP GUARD

This U.S. patent application claims priority to U.S. Ser. No. 12/571,595 titled Crossbow Grip Guard, filed on Oct. 1, 2009, which is incorporated herein by reference, which claims priority to U.S. Ser. No. 11/489,773 titled Crossbow Grip Guard, filed on Jul. 20, 2006, which is incorporated herein by reference, and which claims priority to U.S. Provisional patent application Ser. No. 60/700,876 titled, Crossbow Grip Guard, filed on Jul. 20, 2005, which is incorporated herein by reference.

I. BACKGROUND OF THE INVENTION

A. Field of Invention

This invention pertains to the art of methods and apparatuses for safely discharging a crossbow device. This invention more specifically pertains to a safety device that maintains the fingers of the operator in a safe position during discharge of the crossbow device. This invention also more specifically pertains to a crossbow grip guard that aids the operator in maintaining proper finger orientation and proper holding of a crossbow in aiming and discharging the crossbow.

B. Description of the Related Art

It is known in the art to draw back the bowstring for a crossbow device. Since crossbows propel the bolts there from with the force of the bowstring, a substantial bowstring force is needed to accurately target the intended game. As a result, during discharge of the crossbow the force is exerted on the projectile through the bowstring.

It is also known that during discharge of the cross bow and bowstring respectively certain associated operator's have placed a thumb or finger in the path of the moving bowstring, causing injury to the associated operator's appendage. What is needed is a device that maintains the appendages of the associated operator's hand that grasps the stock of the crossbow in a safe location during discharge of the crossbow and bowstring.

II. SUMMARY OF THE INVENTION

According to one embodiment of the invention, a device may comprise a main body. The main body may be adapted to be attached to a stock of an associated crossbow and may prevent a finger of an associated user from extending above the top portion of the stock when firing the crossbow.

According to another embodiment of the invention, a device may comprise a main body and a member. The main body may be adapted to be attached to a stock of an associated crossbow and may prevent a finger of an associated user from extending above the top portion of the stock when firing the crossbow. The member may extend outwardly away from an exterior surface of the main body to create an obstacle positioned along a length of the main body and may be designed to prevent the finger of the associated user from extending above the top portion of the stock when firing the associated crossbow.

According to another embodiment of the invention, a device may comprise a main body and a member. The main body may be adapted to be attached to a stock of an associated crossbow and may prevent a finger of an associated user from extending above the top portion of the stock when firing the crossbow. The main body may comprise an inside curvature formed on an underside portion of the main body. The inside curvature may be shaped to receive at least a portion of the stock. The member may extend outwardly away from an exterior surface of the main body to create an obstacle positioned along a length of the main body and may be designed to prevent the finger of the associated user from extending above the top portion of the stock when firing the associated crossbow.

According to one embodiment of the invention, a crossbow grip guard may comprise a main body and an outwardly extending member. The main body may comprise an inside curvature and a conventional fastener. The inside curvature may be shaped to receive at least a portion of a stock of an associated crossbow. The conventional fastener may be for selectively attaching the crossbow grip guard to the associated crossbow. The outwardly extending member may extend away from an exterior surface of the main body to create an obstacle positioned along a portion of a length of the main body. When the crossbow grip guard is attached to the associated crossbow, the obstacle maybe designed to prevent a finger of an associated user from extending above a top portion of the stock when firing the associated crossbow.

According to one embodiment, a method may comprise the steps of: (a) providing a crossbow grip guard comprising a main body comprising an inside curvature shaped to allow a first portion of a stock of an associated crossbow to be received into a recess at least partially defined by the inside curvature; and, an outwardly extending member, wherein the outwardly extending member extends away from an exterior surface of the main body to create an obstacle positioned along a length of the main body, wherein the obstacle is designed to prevent a finger of an associated user from extending above a top portion of the stock when firing the associated crossbow; (b) positioning the crossbow grip guard over the first portion of the stock; and, (c) attaching the crossbow grip guard to the associated crossbow.

One advantage of the invention is that the grip guard may at least partially ensure that an associated user does not extend a finger above the top portion of the stock when firing a crossbow.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
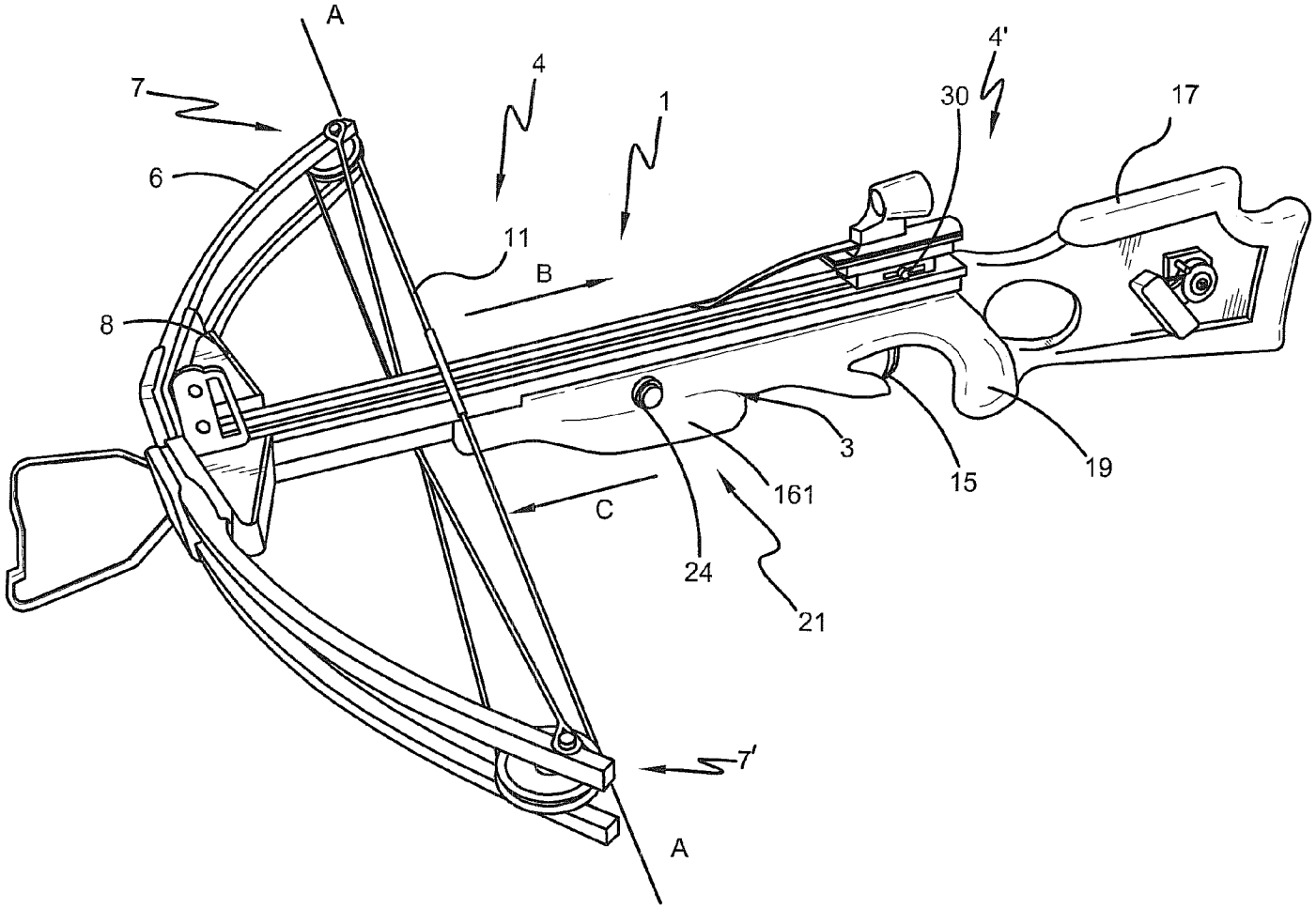
FIG. 1 is a picture of a crossbow having a stock safety device.

Referring now to the drawings wherein the showings are for purposes of illustrating an embodiment of the invention only and not for purposes of limiting the same, FIG. 1 shows a crossbow depicted generally at 1. The crossbow 1 may include a crossbow stock 3. The stock 3 may be generally longitudinal having first and second ends 4, 4' respectively. A crossbar 6 may be juxtaposed to the first end 4 of the stock 3 and fixedly connected thereto in a manner well known in the art. The crossbar 6 may include first and second ends 7, 7' that define an axis A that extends generally perpendicular to the longitudinal axis of the stock 3. The ends 7, 7' of the crossbar 6 may receive a bowstring 11 that extends between the ends 7, 7' of the crossbar 6 in a manner well known in the art. The crossbow 1 may be configured such that when the bowstring 11 is drawn back in a first direction B, the crossbar 6 may flex or bend storing potential energy in the device 1. The bowstring 11 may be secured in place by a trigger mechanism 15 having a crossbow string latch, not shown, that selectively holds the bowstring 11 until it is desired to release or discharge the crossbow 1. When an associated operator draws the crossbow string back the string 11 is received by the latch, not shown, and is held in place until the trigger mechanism 15 is released. Once the crossbow string 11 has been drawn back, an associated operator may place a projectile or bolt, not shown, onto the top portion of the stock 3 and fit a first end of the bolt over the bowstring 11. After such time, the trigger mechanism 15 may be engaged; releasing the force stored in the device 1 and propelling the projectile forward in a direction C.

Figure 2:
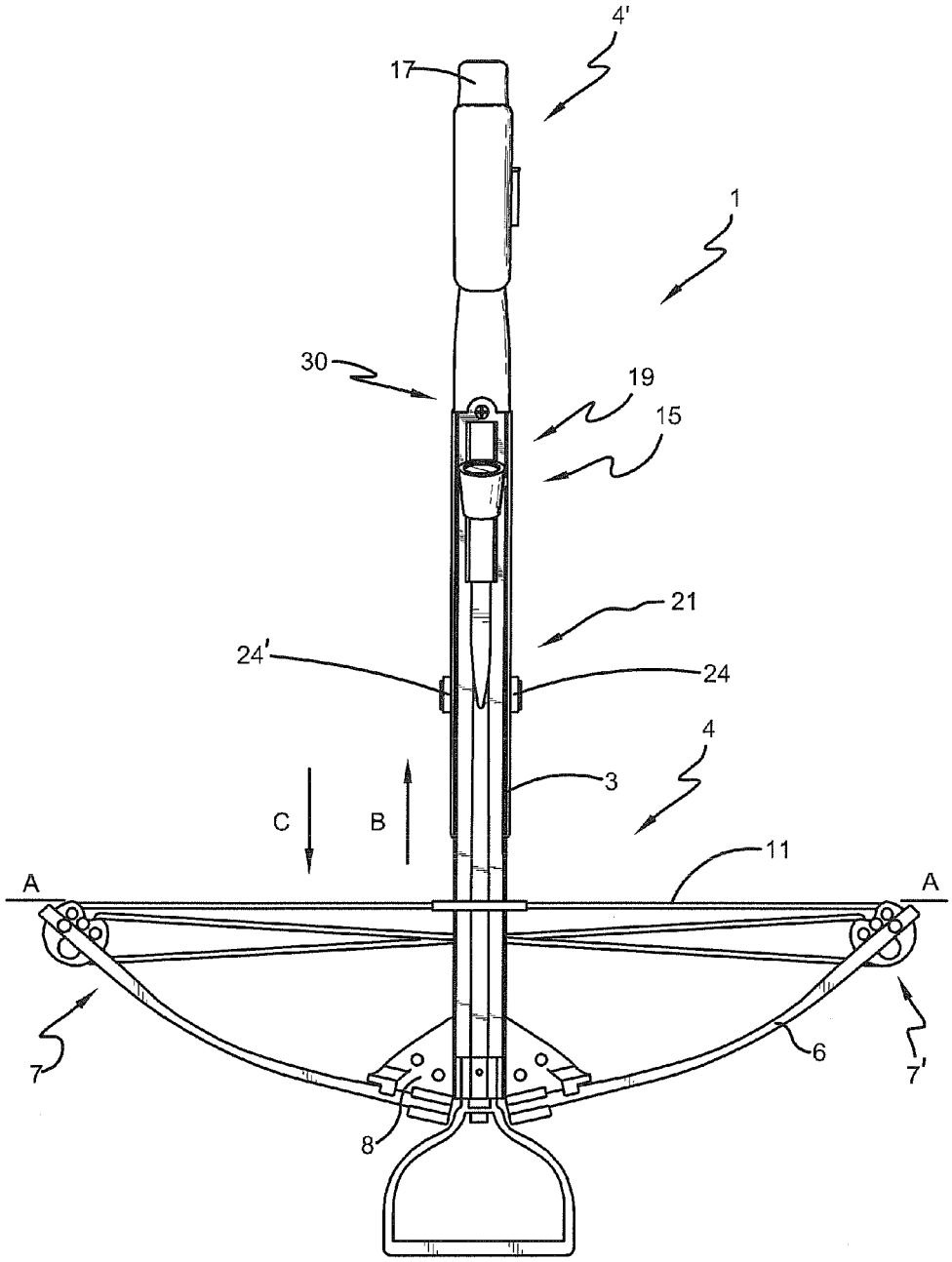
FIG. 2 is a picture of a crossbow having a stock safety device.

With reference now to FIGS. 1 and 2, the crossbow 1 may include a crossbow butt 17. The butt 17 of the crossbow 1 may be juxtaposed to the associated operator's shoulder during discharge of the device 1. A grip 19 may be fashioned in the stock 3 wherein the trigger mechanism 15 is installed proximate to the grip 19; toward the second end 4' of the stock 3. This allows the associated operator to securely grasp the crossbow 1 with a first hand during operation of the device 1. The other hand of the associated operator may grasp the stock 3 toward the first end 4 thereof. This allows the operator to firmly hold the crossbow 1 during operation and discharge.

Figure 3:
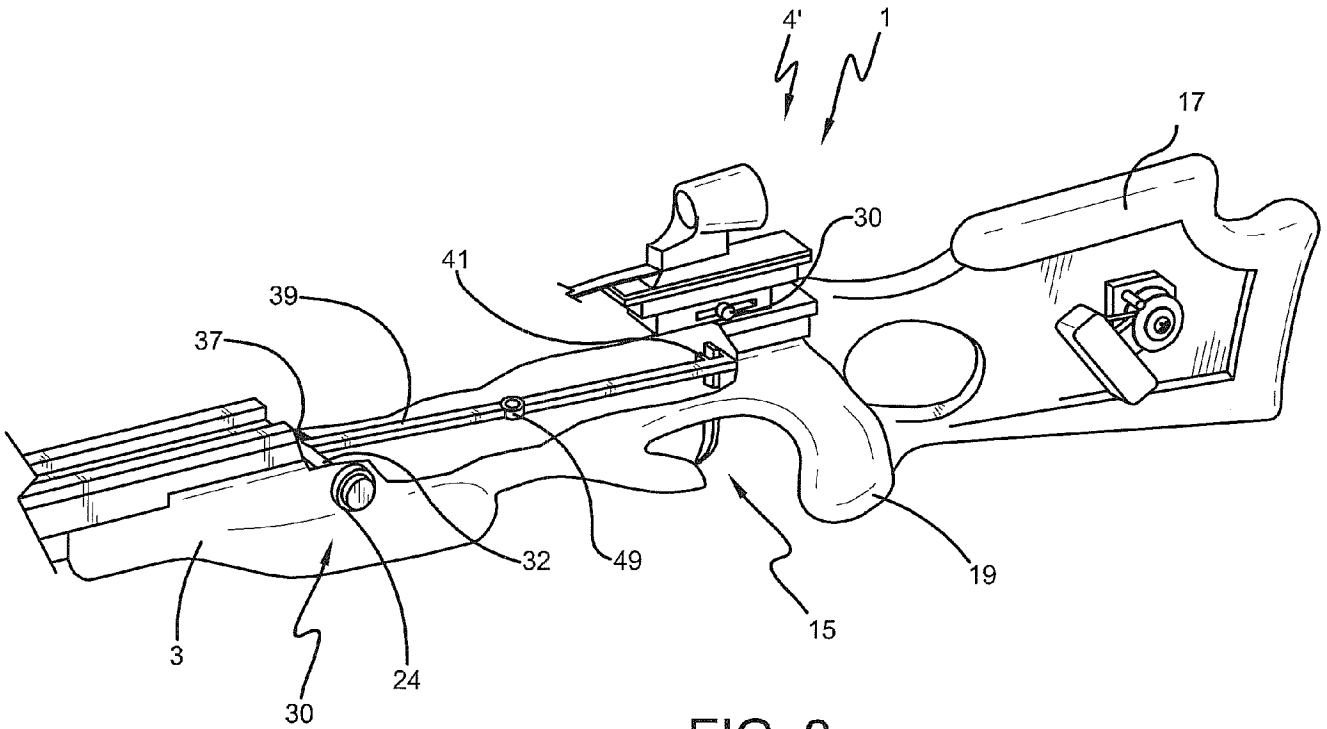
FIG. 3 is a picture of a crossbow having a stock safety device.

With reference again to FIGS. 1 and 2 and now to FIG. 3, the crossbow 1 may include a safety 30 for use in preventing the trigger mechanism 15 from engaging and thus from preventing discharge of the crossbow 1 when the bowstring 11 is drawn back. The safety 30 may be a mechanical safety interconnected to the trigger mechanism 15 such that when the safety 30 is engaged the trigger mechanism 11 cannot be operated, which prevents the crossbow 1 from being fired as previously discussed. In other words, when the safety 30 is engaged the trigger mechanism 15 cannot be pulled back or fired. The safety 30 may be configured in any manner chosen with sound engineering judgment. In one embodiment, the safety 30, when engaged, prevents the trigger mechanism 15 from firing by placing a mechanical block into the path of the trigger mechanism 15 thereby preventing the trigger mechanism 15 from moving and thereby preventing the crossbow 1 from firing.

With reference to FIGS. 1 through 3, the crossbow 1 may also include a safety mechanism 21 for preventing the crossbow from firing when the operator appendages are in the path of the traveling projectile. In one embodiment, the safety mechanism 21 may be a stock safety mechanism or stock safety 21. The stock safety 21 may include a first push button 24 mounted proximate to the position where the associated operator would grasp the stock 3 of the crossbow 1 during operation. In this manner, the crossbow 1 may only be fired when the stock safety button 24 is depressed. Since depressing the button 24 requires the use of the operator's thumb, and/or fingers on the opposing side of the stock, to apply pressure to the button 24, the crossbow may only be fired when the thumb and/or finger is in contact with the button 24. In that the button 24 is disposed on the stock 3 and below the path of travel of the bowstring, the bowstring cannot cause injury to the thumb and/or fingers thus providing a safety mechanism that prevents injury to the hand grasping the stock of the crossbow 1. It is noted here that a firm grip on the stock 3 of the crossbow 1 is needed to properly fire the crossbow. Thus, the safety mechanism 21 would allow the operator to properly grasp the stock 3 while engaging the safety mechanism 21. The position of the stock safety 21 may reside on the either side of the stock depending on the handedness of the associated operator. In other words, the stock safety 21 may be configured for either a left-handed or a right-handed operator. In an alternate embodiment, the stock safety 21 may include first 24 and second 24' buttons, wherein the buttons 24, 24' reside one on each side of the stock 3 respectively. In this manner, the stock safety 21 may require the operator to depress the first button 24 with the operator's thumb, for example and to depress the second button 24' with the operator's fingers simultaneously to disengage the stock safety 21 for discharging the crossbow 1. It is noted that the stock safety 21 is normally engaged or biased in a default position to prevent firing of the crossbow. That is to say that when the crossbow 1 is set down after use, the safety mechanism 21 is biased to automatically engage thus preventing the trigger mechanism from moving. It is also noted here that the safety mechanism 21 works in conjunction with the safety 30. Both safeties must be disengaged for the crossbow 1 to be fired.

Figure 4:
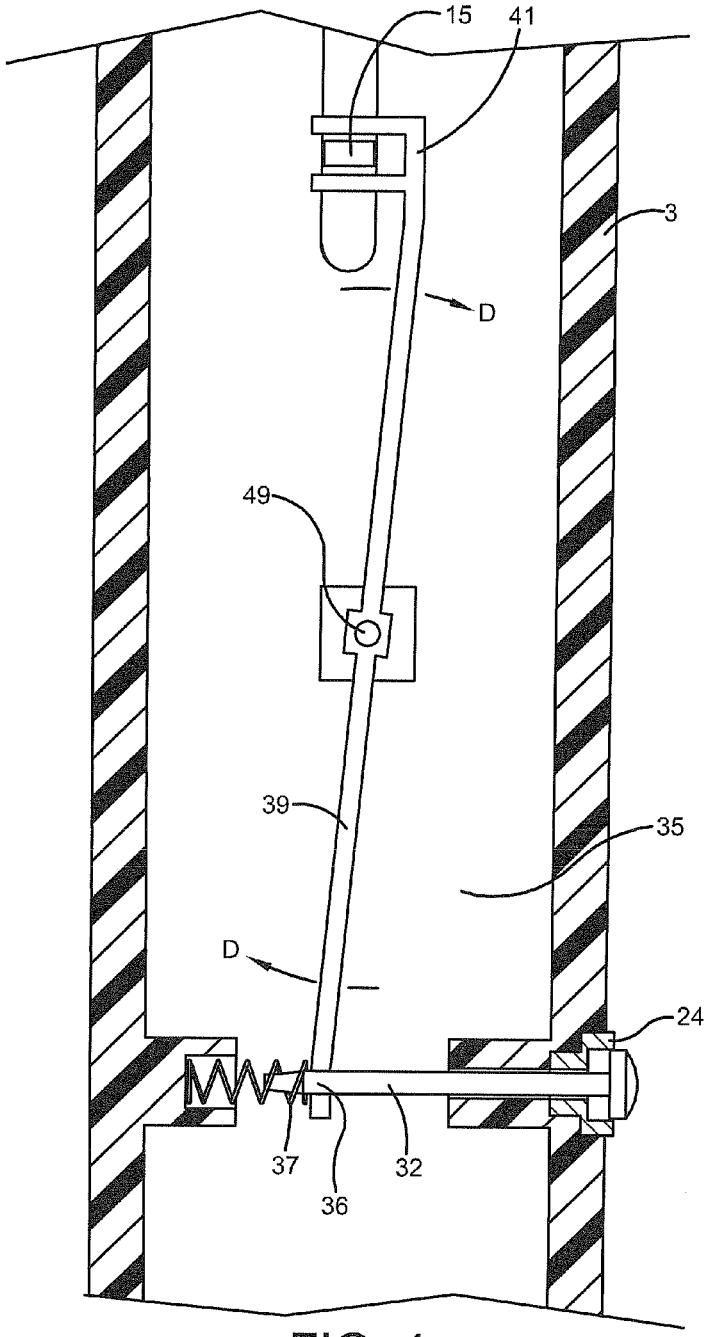
FIG. 4 is a partial cutaway top view of the stock of a crossbow having a stock safety device.

With continued reference to FIGS. 1 through 3 and now to FIG. 4, the push button 24 may be disposed within the stock 3 of the crossbow 1 and extended to the exterior of the stock 3 for access by the operator. On the inside of the stock 3, the push button 24 may be connected to a rod member 32. The first end 36 of the rod member 32 may contact biasing means 37, which may be a spring 37, for use in biasing the push button 24 into a default position. Any type of biasing means may be chosen with sound engineering judgment as is appropriate for use with the present invention. In this manner, when the operator releases the push button 24, the rod member 37 and the push button 24 return to a default safety state as biased by the spring 37. A rigid linkage member 39 may also be included that is fixedly connected to the rod member 32 at a first end of the linkage member 39. The distal end of the rigid linkage member 39 may include a bifurcated portion 41 that may engage the trigger mechanism 15. The bifurcated portion 41 may be integrally formed with linkage member 39. However, any configuration of linkage member 39 and bifurcated portion 41 may be chosen with sound engineering judgment. Accordingly, the entire linkage member 39 may be pivotally connected with respect to the body of the stock 3, thereby allowing the linkage member 39 and the bifurcated portion 41 to pivot into and out of engagement with the trigger mechanism 15, as shown in FIG. 4. It is noted here that the linkage member 39 may pivot about a fixed point 49 within the stock 3 but may not move otherwise. Any manner of allowing the linkage member 39 to pivot without otherwise translating may be chosen with sound engineering judgment. When the operator depresses the push button 24, thus overcoming the force of the biasing means 37, the rod member 32 may pivot the linkage member 39 and more specifically the bifurcated end 41 of the linkage member 39 out of engagement with the trigger 15. Therefore, the stock safety 21 is normally engaged, and must be intentionally disengaged in order to pull the trigger mechanism 15 thus firing the crossbow 1. It should be emphasized that the present embodiment discusses a mechanical safety mechanism 21 including a mechanical linkage member 39. However, it is noted that any assembly and/or configuration of linkage members, including but not limited to mechanical, electrical, electromagnetic, and the like may be chosen with sound engineering judgment.

Figure 5:
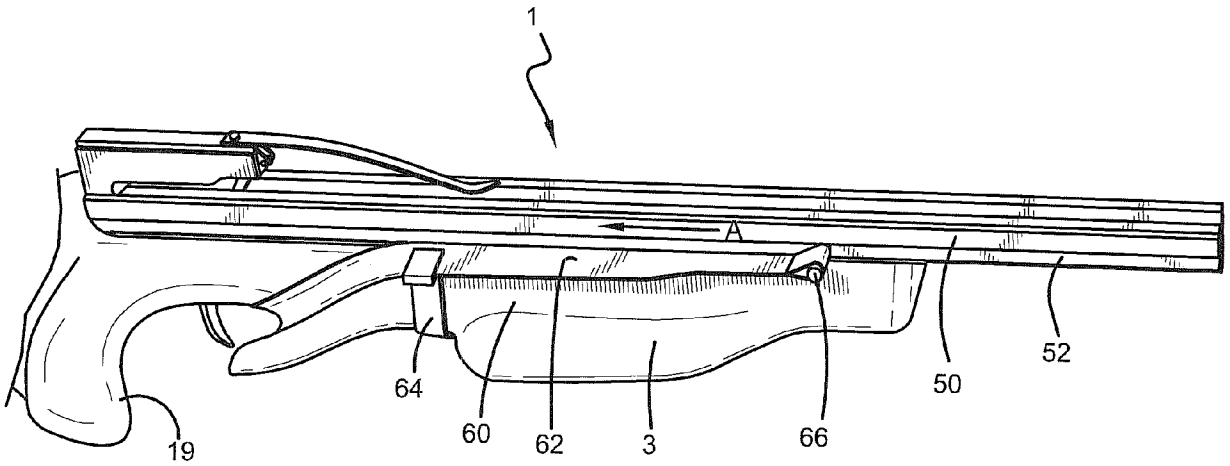
FIG. 5 is a side view of a crossbow showing the crossbow grip guard retro-fitted to an existing crossbow.
Figure 6:
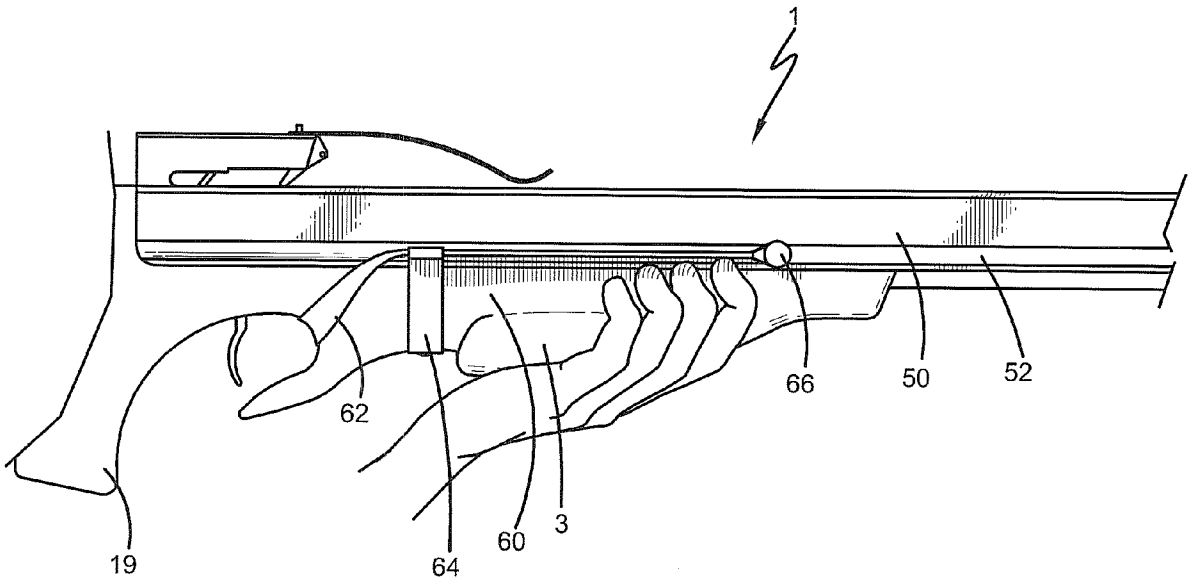
FIG. 6 is a side view of a crossbow having the crossbow grip guard.

With reference to FIGS. 5 and 6, a grip guard 60 is shown. The grip guard 60 has an outwardly extending member 62. The outwardly extending member 62 extends outwardly perpendicular to the stock 3 and a barrel 50 of the crossbow 1. The outwardly extending member 62 need not be exactly perpendicular to a longitudinal axis of the barrel 50 or stock 3. The grip guard 60 may also have a locking member 64 that secures the outwardly extending member 62 to the stock 3. The need for the locking member 64 would be where the grip guard 60 is retro-fitted to an existing crossbow 1. In that case, there is also an axis 66 that slides within the opening 52 of the barrel 50. The outwardly extending member 62 is secured to the axis 66. The axis 66 is secured in place by the force of the outwardly extending member 62 pulling in a direction toward the butt (not shown) of the crossbow 1. This force is shown in FIG. 5 in the direction of arrow A. Locking member 64 engages outwardly extending member 62 to ensure that it in fact stays outward (i.e., perpendicular). The outwardly extending member 62 is typically made of sheet metal, however, it can be made of any material which accomplishes the objective of extending the outwardly extending member 62. The locking member 64 travels across to the other side of the crossbow 1, which is a mirror image of the side shown in FIGS. 5, 6. The outwardly extending member 62 extends around, under and through the grip 19 as shown within FIGS. 5, 6. It is typically made of one solid piece of material, such as rubber, however, any material accomplishing the intended function of the outwardly extending member 62 is within the scope of this invention, including multiple, separate pieces.

The objective of the grip guard is to keep the operator's fingers below the bolt path. The grip guard ensures that this should be avoided by making it an obstacle for an operator's fingers to extend over the grip guard 60 and onto the path of a bolt. The grip guard also serves as a tactical reminder of the proper hand position for gripping a crossbow. Therefore, any means that accomplishes that end result is within the scope of the grip guard.

Figure 7:
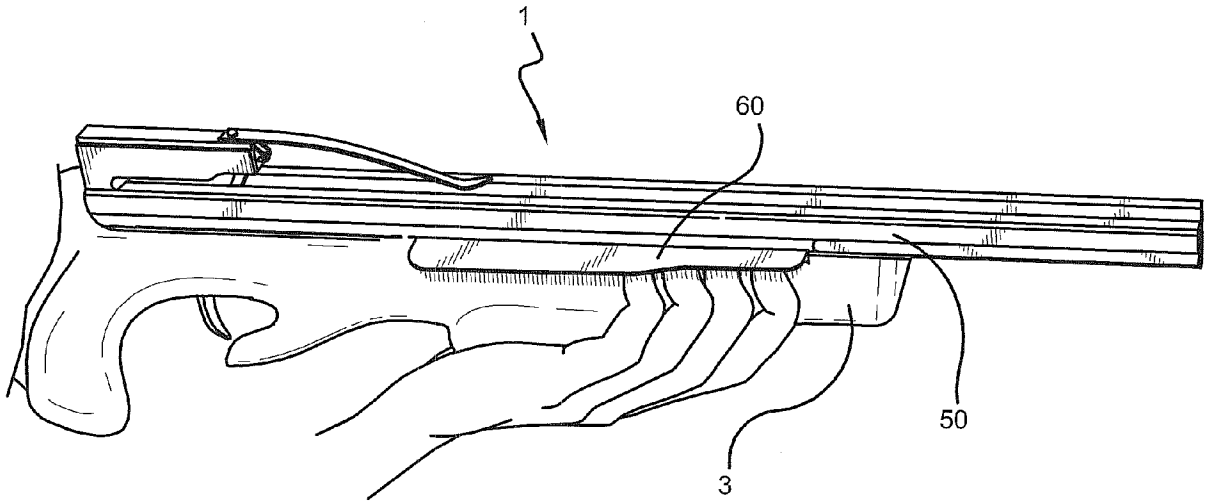
FIG. 7 is a view of a crossbow where the crossbow grip guard is molded into the stock.
Figure 7A:
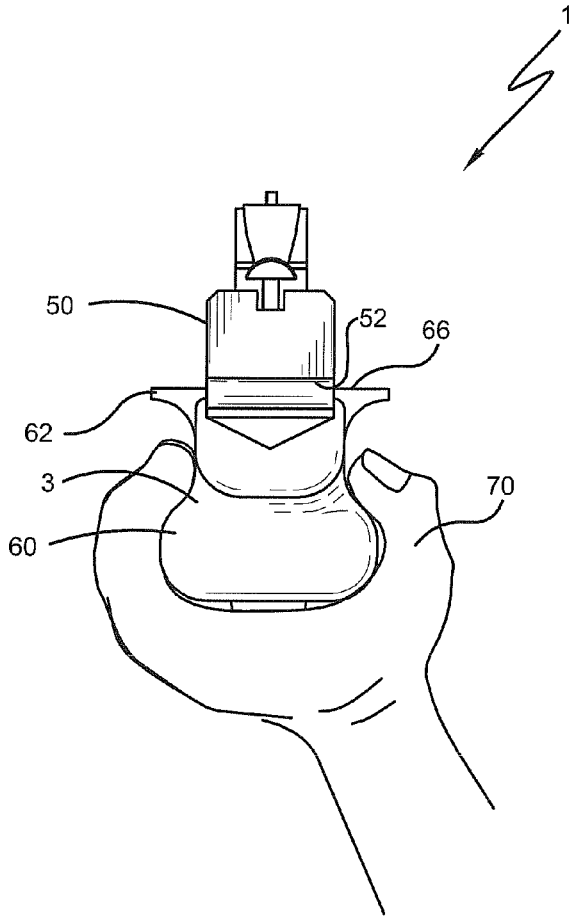
FIG. 7A is an end view of a crossbow having the crossbow grip guard molded into the stock.
Figure 8:
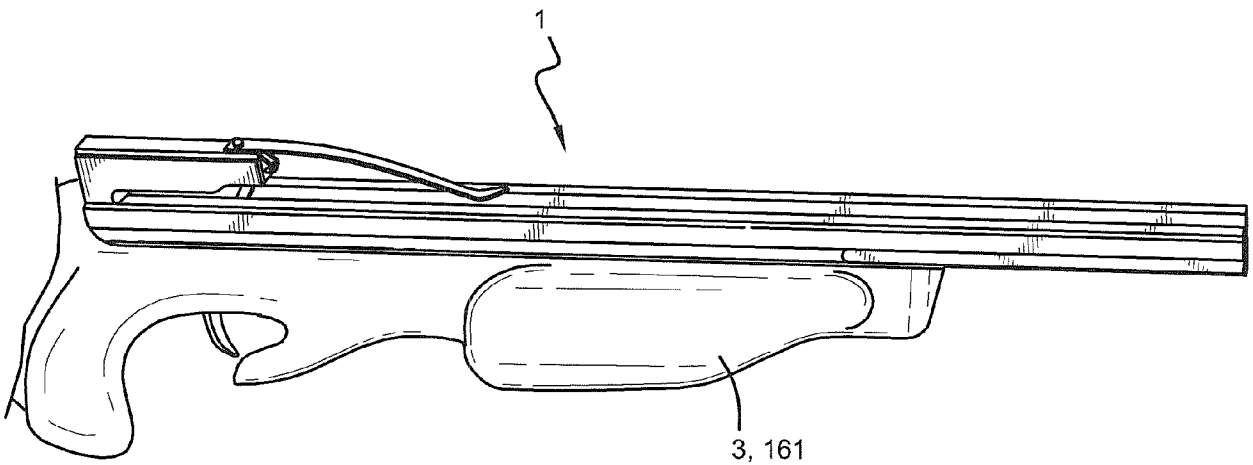
FIG. 8 is a side view of a crossbow having an enlarged stock such that a normal user's fingers are unable to reach into the bolt path.
Figure 8A:
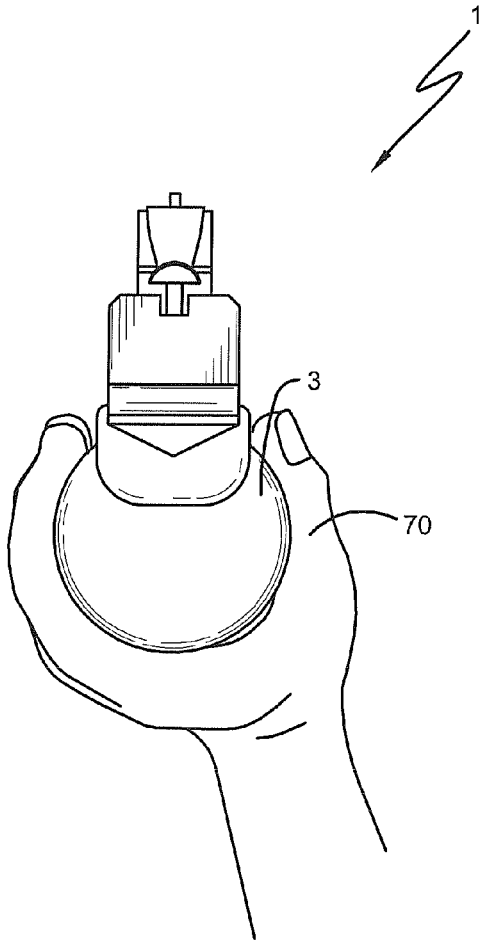
FIG. 8A is an end view of a crossbow having an enlarged crossbow stock.
Figure 9:
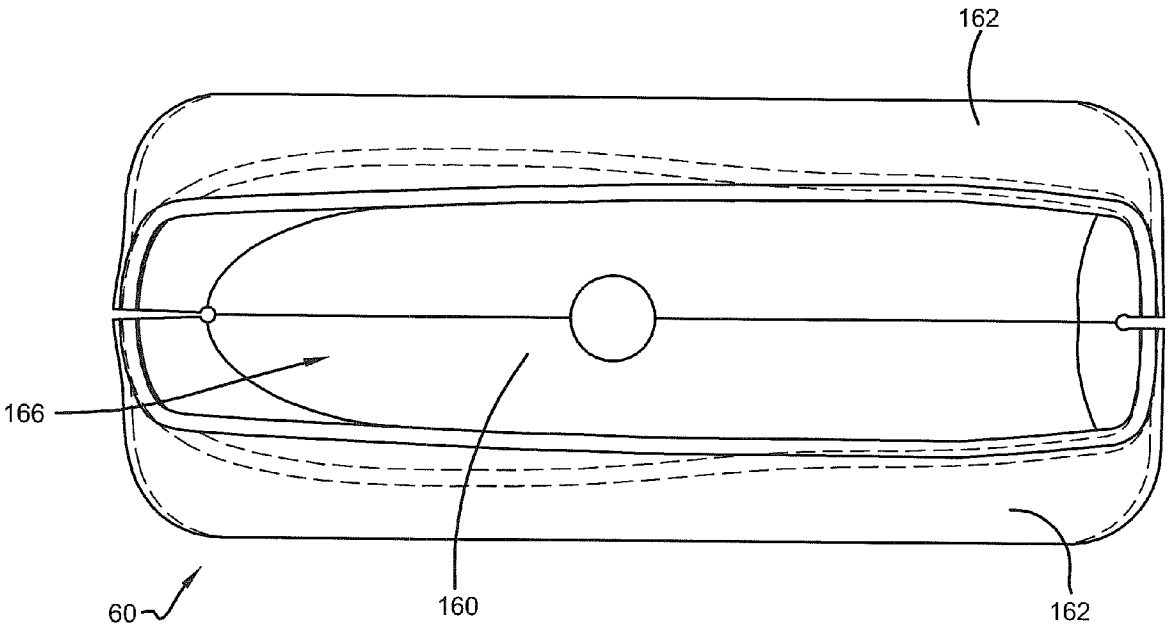
FIG. 9 is a bottom elevational view of a grip guard for an existing crossbow, wherein an inside contour of a main body of the grip guard is shown utilizing broken lines, according to one embodiment of the invention.
Figure 10:
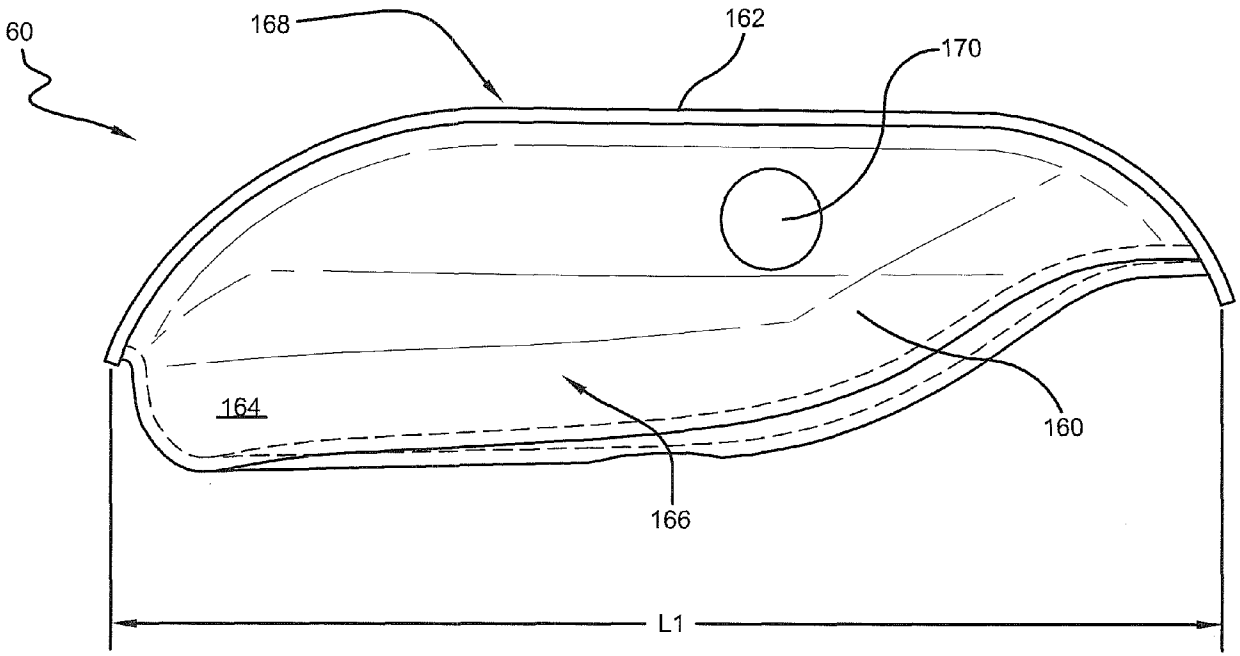
FIG. 10 is a side elevational view of a grip guard for an existing crossbow, wherein an inside contour of a main body of the grip guard is shown utilizing broken lines, according to one embodiment of the invention.
Figure 11:
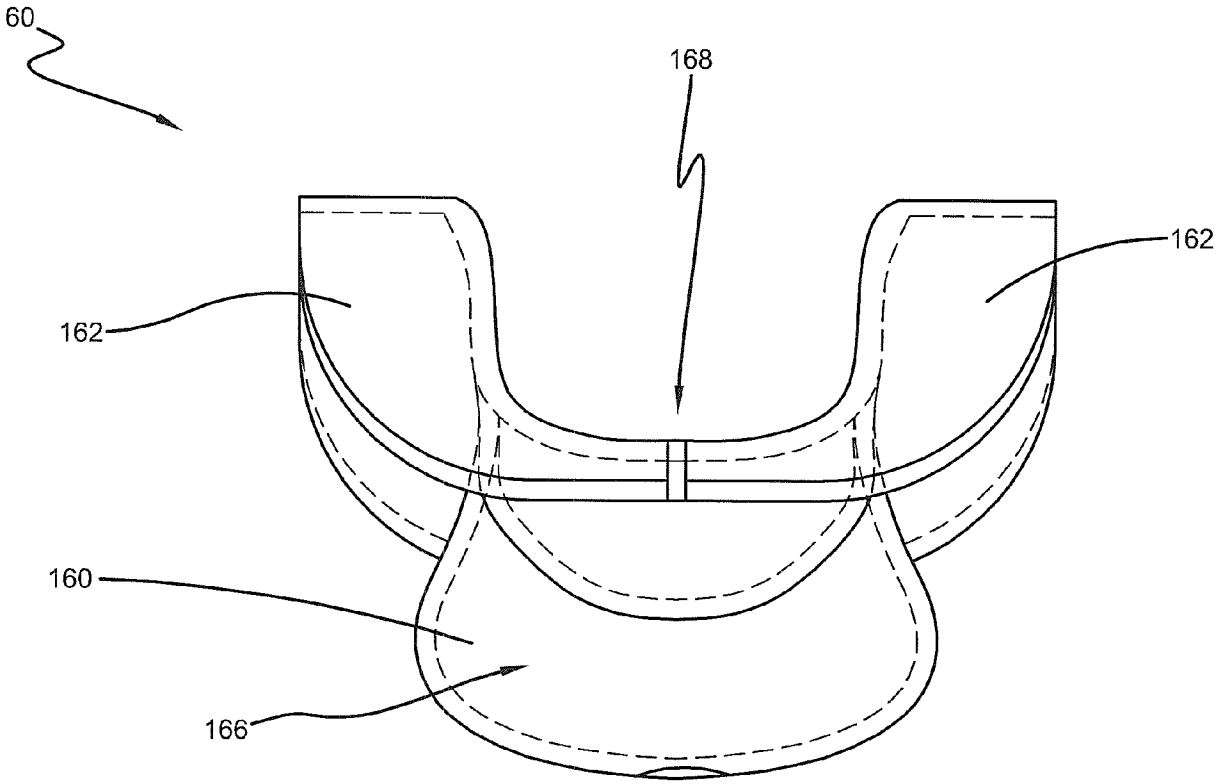
FIG. 11 is a front elevational view of a grip guard for an existing crossbow, wherein an inside contour of a main body of the grip guard is shown utilizing broken lines, according to one embodiment of the invention.
Figure 12:
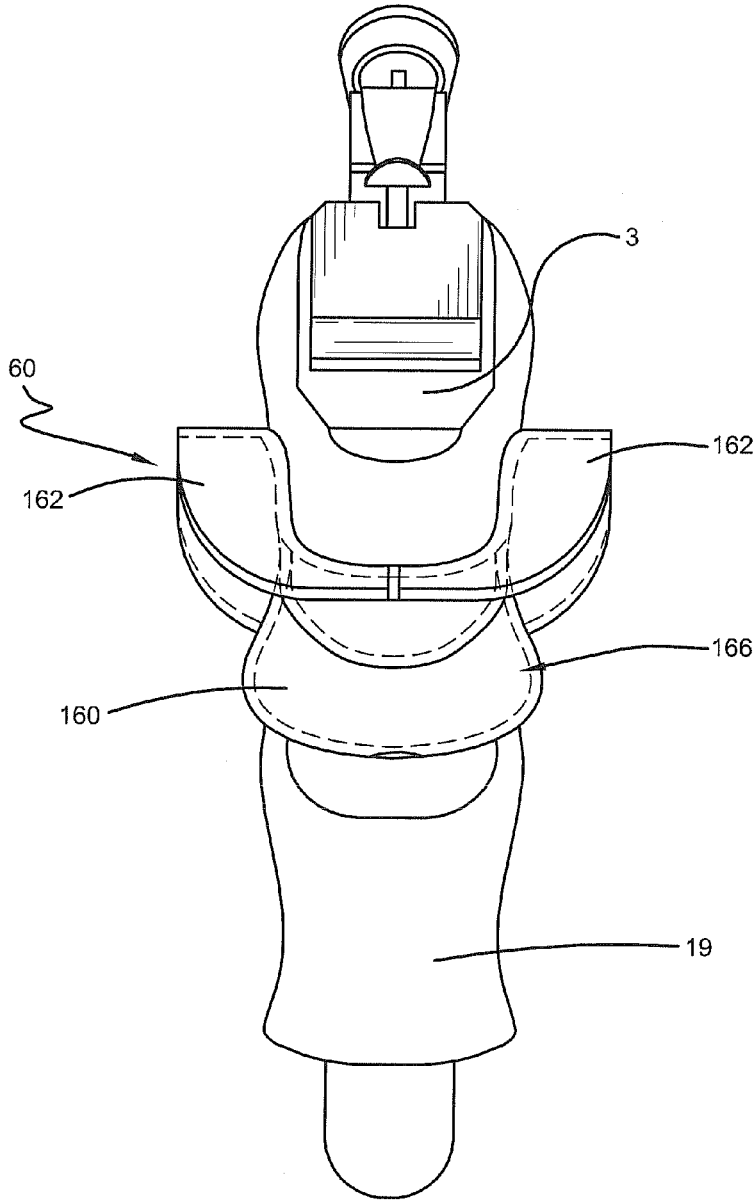
FIG. 12 is a partial front perspective view of a crossbow having a grip guard for an existing crossbow, wherein an inside contour of a main body of the grip guard is shown utilizing broken lines, according to one embodiment of the invention.
Figure 13:
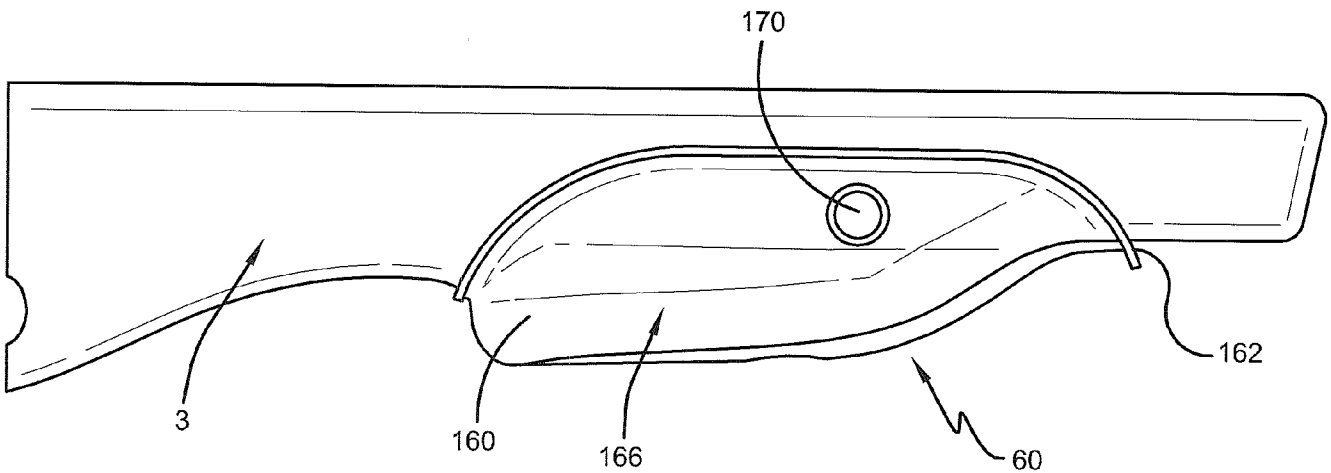
FIG. 13 is a partial side perspective view of a crossbow having a grip guard for an existing crossbow, wherein an inside contour of a main body of the grip guard is shown utilizing broken lines, according to one embodiment of the invention.
Figure 14:
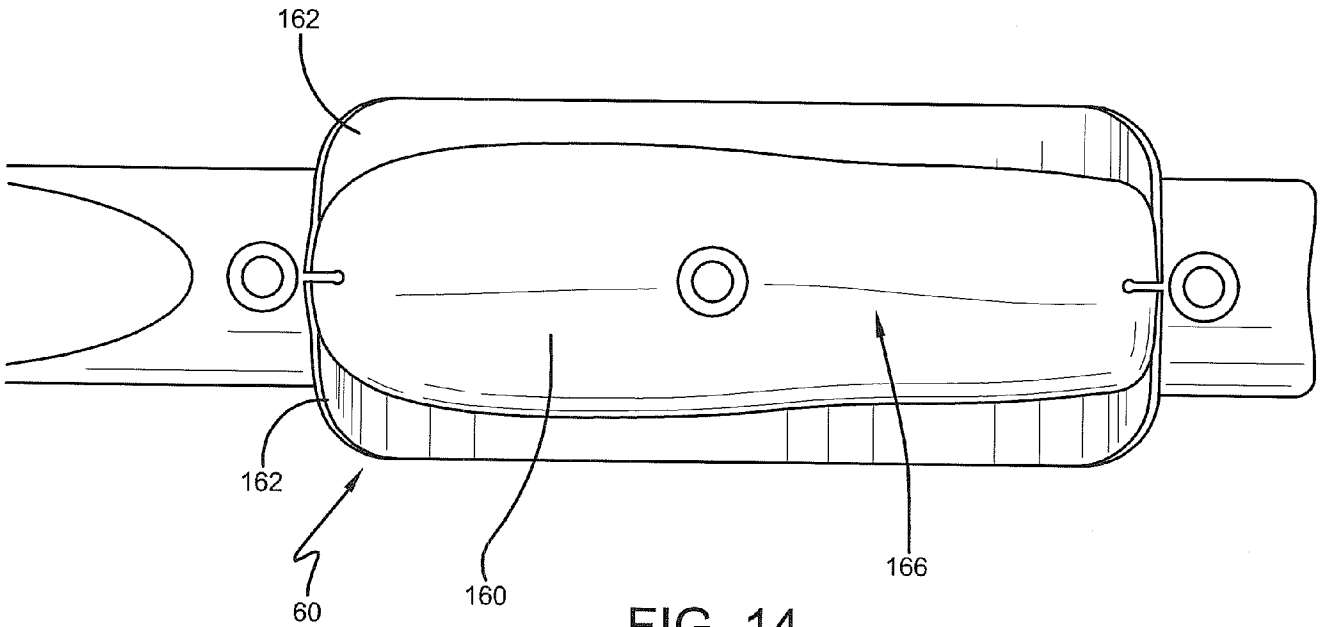
FIG. 14 is a partial bottom perspective view of a crossbow having a grip guard for an existing crossbow, wherein an inside contour of a main body of the grip guard is shown utilizing broken lines, according to one embodiment of the invention.

FIG. 7 shows that the grip guard 60 may also be molded within the crossbow 1. The molded grip guard 60 could be molded within the stock 3 and extend outwardly of the barrel 50. With respect to FIG. 7A, the grip guard 60 is shown from an end view. The outwardly extending member 62 is molded within the stock 3. A normal user's hand 70 is shown in FIG. 7A. Outwardly extending member 62 extends outwardly from the stock 3 such that the user's hand 70 would not extend above outwardly extending member 62. While it is possible for larger hand 70 to be able to extend beyond extending member 62, it would be difficult and awkward for such occurrence.

With reference now to FIGS. 1, 9-14, according to one embodiment, the grip guard 60 may be adapted to be retro-fitted to the crossbow 1. The grip guard 60 may comprise a main body 160. The main body 160 may be adapted to be attached to the stock 3 and may prevent a finger of the associated user from extending above the top portion of the stock 3 when firing the crossbow 1. The grip guard 60 may further comprise a member 162. The member 162 may extend outwardly away from an exterior surface 164 of the main body 160 to create an obstacle or barrier positioned along at least a portion of a length L1 of the main body 160 and may be designed to prevent the finger of the associated user from extending above the top portion of the stock 3. In one embodiment, the main body portion 160 and the outwardly extending member 162 may be integrally formed into a single device. In another embodiment, the outwardly extending portion 162 may comprise a separate component that is operatively connected to the main body portion 160. The main body 160 may comprise the exterior surface 164 and an inside curvature 166. The exterior surface 164 may be shaped to receive the hand of the user when aiming or firing the crossbow 1. In one embodiment, the exterior surface 164 may comprise a shape that is substantially similar to the shape of a stock grip 161 positioned on the stock 3 where the user would normally grasp the stock 3 when firing the crossbow 1. The inside curvature 166 may be formed on the underside surface of the main body 160 and may be correspondingly shaped to a portion of the stock 3 that can be received into the recess 168 that is at least partially defined by the inside curvature 166. In one embodiment, a portion of the stock 3 may be received into the recess 168 such that the grip guard 60 "snaps onto" the stock 3. The grip guard 60 may snap onto the stock 3 such that the sides of the main body 160 deflect slightly outward as a portion of the stock 3 is received into the recess 168 and then return to their original position thereby holding or attaching the grip guard 60 to the stock 3. In another embodiment, the inside curvature 166 may be shaped to receive at least a portion of the stock grip 161. In yet another embodiment, the main body 160 may comprise an aperture 170. The aperture 170 may at least partially allow the grip guard 60 to be utilized with a crossbow 1 comprising the stock safety device 21, described above, by allowing the user to actuate the push button 24 while the grip guard 60 is attached to the stock 3.

With continued reference to FIGS. 1, 9-14, the grip guard 60 may comprise a means for selectively and/or fixedly attaching the grip guard 60 to the stock 3. In one embodiment, the grip guard 60 may be attached to the stock 3 utilizing conventional fasteners including, but not limited to an adhesive, such as, for example, tape or glue; hook and loop fasteners, such as, for example, Velcro®; and/or screws. The grip guard 60 may be selectively and/or fixedly attached to the stock 3 utilizing any type of fastener, device, and/or method chosen with sound judgment by a person having ordinary skill in the art.

With continued reference to FIGS. 1, 9-14, a method for attaching the grip guard 60 to the crossbow 1, according to one embodiment, will be described. The grip guard 60 adapted to be retro-fitted or attached to a conventional crossbow and comprising the main body 160 having the inside curvature 166 shaped to allow a portion of the stock 3 to be received into the recess 168 at least partially defined by the inside curvature 166; and, the outwardly extending member 162, as described above, may be provided. The grip guard 60 may be positioned over the first portion of the stock 3 such that the first portion of the stock 3 is received into the recess 168 and is adjacent to the inside curvature 166. In one embodiment, the first portion of the stock 3 may comprise the stock grip 161 and the grip guard 60 may substantially encompass the stock grip 161. The grip guard 60 may then be selectively and/or fixedly attached to the stock 3. In one embodiment, the grip guard 60 may comprise a length of tape positioned on the underside portion 168 of the main body 160 such that the tape can adhere or attach the grip guard 60 to a portion of the stock 3 when the stock 3 is received by the main body 160. In another embodiment, the grip guard 60 may comprise hook and loop fasteners positioned on the underside portion 168 of the main body 160 and on the first portion of the stock 3 such that the hook and loop fasteners can attach the grip guard 60 to the first portion of the stock 3 when the first portion of stock 3 is received by the main body 160. In yet another embodiment, the grip guard 60 may comprise a plurality of screws that can be inserted through a plurality of apertures formed through the main body 160 and received by corresponding threads formed in the first portion of the stock 3.

An oversized crossbow stock embodiment is directed to a circular crossbow stock, wherein at least a cross-sectional portion of the stock that is perpendicular to the longitudinal axis of the crossbow barrel as an outer circumference length ranging from about 5 to 8 inches. In another embodiment, the cross-sectional portion of the stock that is perpendicular to the longitudinal axis of the crossbow barrel has an outer circumference length of about 5¼ inches.

It will be apparent to those skilled in the art that the above methods may incorporate changes and modifications without departing from the general scope of this invention. It is intended to include all such modifications and alterations in so far as they come within the scope of the appended claims or the equivalents thereof.

We claim:

1. A device comprising:

a main body, wherein the main body is adapted to be attached to a stock of an associated crossbow positioned substantially along said stock and prevents a finger of an associated user from extending above a top portion of the stock when firing the associated crossbow; and a member that extends outwardly away from an exterior surface of the main body to create an obstacle positioned along a length of the main body and is designed to prevent the finger of the associated user from extending above the top portion of the stock when firing the associated crossbow.

2. The device of claim 1, wherein the main body further comprises:

an inside curvature formed on an underside portion of the main body and shaped to received at least a portion of the stock.

3. The device of claim 1, wherein the main body further comprises:

an inside curvature formed on an underside portion of the main body and shaped to received at least a portion of a stock grip of the associated crossbow.

4. The device of claim 1, further comprising:

a conventional fastener for selectively attaching the main body to at least a portion of the stock.

5. The device of claim 4, wherein the conventional fastener comprises a fastener selected from the group consisting of an adhesive, hook and loop fasteners, and a screw.

6. The device of claim 1, wherein the main body further comprises:

a first aperture, wherein the first aperture is adapted to allow the user to actuate a stock safety mechanism positioned on a side surface of the stock.

7. A crossbow grip guard comprising:

a main body comprising an inside curvature shaped to receive at least a portion of a stock of an associated crossbow and a conventional fastener for selectively attaching the crossbow grip guard to the associated crossbow; and, an outwardly extending member, wherein the outwardly extending member extends away from an exterior surface of the main body to create an obstacle positioned along a portion of a length of the main body, wherein when the crossbow grip guard is attached to the associated crossbow, the obstacle prevents a finger of an associated user from extending above a top portion of the stock when firing the associated crossbow.

8. The crossbow grip guard of claim 7, wherein the conventional fastener is selected from the group consisting of an adhesive, hook and loop fasteners, and a screw.

9. The crossbow grip guard of claim 7, wherein the conventional fastener comprises an adhesive positioned on an underside surface of the main body for adhering the crossbow grip guard to the associated crossbow.

10. The crossbow grip guard of claim 9, wherein the adhesive comprises a length of tape.

11. The crossbow grip guard of claim 7, wherein the inside curvature is shaped to receive a portion of a stock grip of the associated crossbow.

12. The crossbow grip guard of claim 7, wherein the crossbow grip guard is positioned substantially around a stock grip formed in the stock of the associated crossbow.

13. The crossbow grip guard of claim 7, wherein the outwardly extending member is integrally formed with the main body.

14. A method comprising the steps of:

(a) providing a crossbow grip guard comprising a main body comprising an inside curvature shaped to allow a first portion of a stock of an associated crossbow to be received into a recess at least partially defined by the inside curvature; and, an outwardly extending member, wherein the outwardly extending member extends away from an exterior surface of the main body to create an obstacle positioned along a length of the main body, wherein the obstacle is designed to prevent a finger of an associated user from extending above a top portion of the stock when firing the associated crossbow;

(b) positioning the crossbow grip guard over the first portion of the stock; and, (c) attaching the crossbow grip guard to the associated crossbow.

15. The method of claim 14, wherein step (b) further comprises the step of:

positioning the crossbow grip guard over a stock grip formed in the stock of the associated crossbow.

16. The method of claim 14, wherein step (c) further comprises the step of:

utilizing an adhesive to attach the crossbow grip guard to the associated crossbow.

17. The method of claim 14, wherein step (c) further comprises the step of:

utilizing a length of tape to attach the crossbow grip guard to the associated crossbow.

18. The method of claim 14, further comprising the step of:

removing the crossbow grip guard from the associated crossbow.

* * * * *